US007021663B1

(12) United States Patent
Moran

(10) Patent No.: US 7,021,663 B1
(45) Date of Patent: Apr. 4, 2006

(54) PUCK DEFLECTING HOCKEY SKATE COVERING

(76) Inventor: Richard J. Moran, 10 Seibert Ct., Park Ridge, NJ (US) 07656

( * ) Notice: Subject to any disclaimer, the term of this patent is extended or adjusted under 35 U.S.C. 154(b) by 153 days.

(21) Appl. No.: 10/683,982

(22) Filed: Oct. 14, 2003

(51) Int. Cl.
*A63C 3/00* (2006.01)

(52) U.S. Cl. ..... 280/811; 280/11.12

(58) Field of Classification Search ..... None
See application file for complete search history.

(56) References Cited

U.S. PATENT DOCUMENTS

| | | | | | |
|---|---|---|---|---|---|
| 1,160,159 | A | * | 11/1915 | Freeman | 280/811 |
| 1,714,760 | A | * | 5/1929 | Bloomberg | 280/811 |
| 2,109,566 | A | * | 3/1938 | Fischer | 280/811 |
| 2,436,187 | A | * | 2/1948 | Bestland | 36/72 R |
| 3,027,660 | A | * | 4/1962 | Werner | 36/7.1 R |
| 3,806,145 | A | | 4/1974 | Czeiszperger | |
| 4,351,537 | A | * | 9/1982 | Seidel | 280/11.12 |
| D287,548 | S | * | 1/1987 | Kraynack-Simon | D3/269 |
| 5,199,726 | A | * | 4/1993 | Willett | 280/11.27 |
| 5,234,230 | A | | 8/1993 | Crane et al. | |
| 5,251,386 | A | * | 10/1993 | Diaz | 36/2 R |
| 5,528,841 | A | * | 6/1996 | Pozzobon | 36/3 A |
| 5,566,476 | A | | 10/1996 | Bertrand et al. | |
| 5,829,170 | A | | 11/1998 | Lutz, Jr. | |
| 5,956,867 | A | * | 9/1999 | Harton | 36/7.1 R |
| 6,223,457 | B1 | | 5/2001 | Graf | |
| 6,421,934 | B1 | * | 7/2002 | Graf | 36/115 |
| 6,854,200 | B1 | * | 2/2005 | Hipp et al. | 36/96 |
| 2003/0196351 | A1 | * | 10/2003 | Hipp et al. | |

* cited by examiner

*Primary Examiner*—Christopher P. Ellis
*Assistant Examiner*—Christopher Bottorff

(57) ABSTRACT

A puck deflecting hockey skate covering includes a covering generally has the shape of a hockey skate and including a toe portion, a pair of side walls, a pair of ankle portions and a back wall. The covering has an open top side and an open bottom side. The covering comprises a substantially rigid material. An outer surface of the covering has a plurality of protrusions thereon. A strap has a first end and a second end wherein the first end is attached to a first of the side walls. A fastener removably fastens the second end of the strap to a second of the side walls such that the strap may selectively traverse the bottom side.

6 Claims, 4 Drawing Sheets

PUCK DEFLECTING HOCKEY SKATE COVERING

BACKGROUND OF THE INVENTION

1. Field of the Invention

The present invention relates to skate covering devices and more particularly pertains to a new skate covering device for absorbing the impact of a hockey puck and controlling the deflection of such.

2. Description of the Prior Art

The use of skate covering devices is known in the prior art. U.S. Pat. No. 3,806,145, U.S. Pat. No. 5,234,230, and U.S. Pat. No. 5,829,170 each describe a covering for positioning on a skate so that the wearer of the skate is affording some protection from a hockey puck. While these devices fulfill their respective, particular objectives and requirements, the need remains for a device that not only protects the foot of the hockey player but also provides the player with better control over the deflection of the hockey puck.

SUMMARY OF THE INVENTION

The present invention meets the needs presented above by including a covering having protrusions thereon which are angles, pyramidal shapes that help to absorb the impact of the puck and give the hockey player better control over where the puck is to be deflected.

Another object of the present invention is to provide a new skate covering device that includes a rigid covering having an inner surface covered with a cushioning material for protecting the foot of the hockey player from hockey puck impacts.

To this end, the present invention generally comprises a covering generally has the shape of a hockey skate and including a toe portion, a pair of side walls, a pair of ankle portions and a back wall. The covering has an open top side and an open bottom side. The covering comprises a substantially rigid material. An outer surface of the covering has a plurality of protrusions thereon. A strap has a first end and a second end wherein the first end is attached to a first of the side walls. A fastener removably fastens the second end of the strap to a second of the side walls such that the strap may selectively traverse the bottom side.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
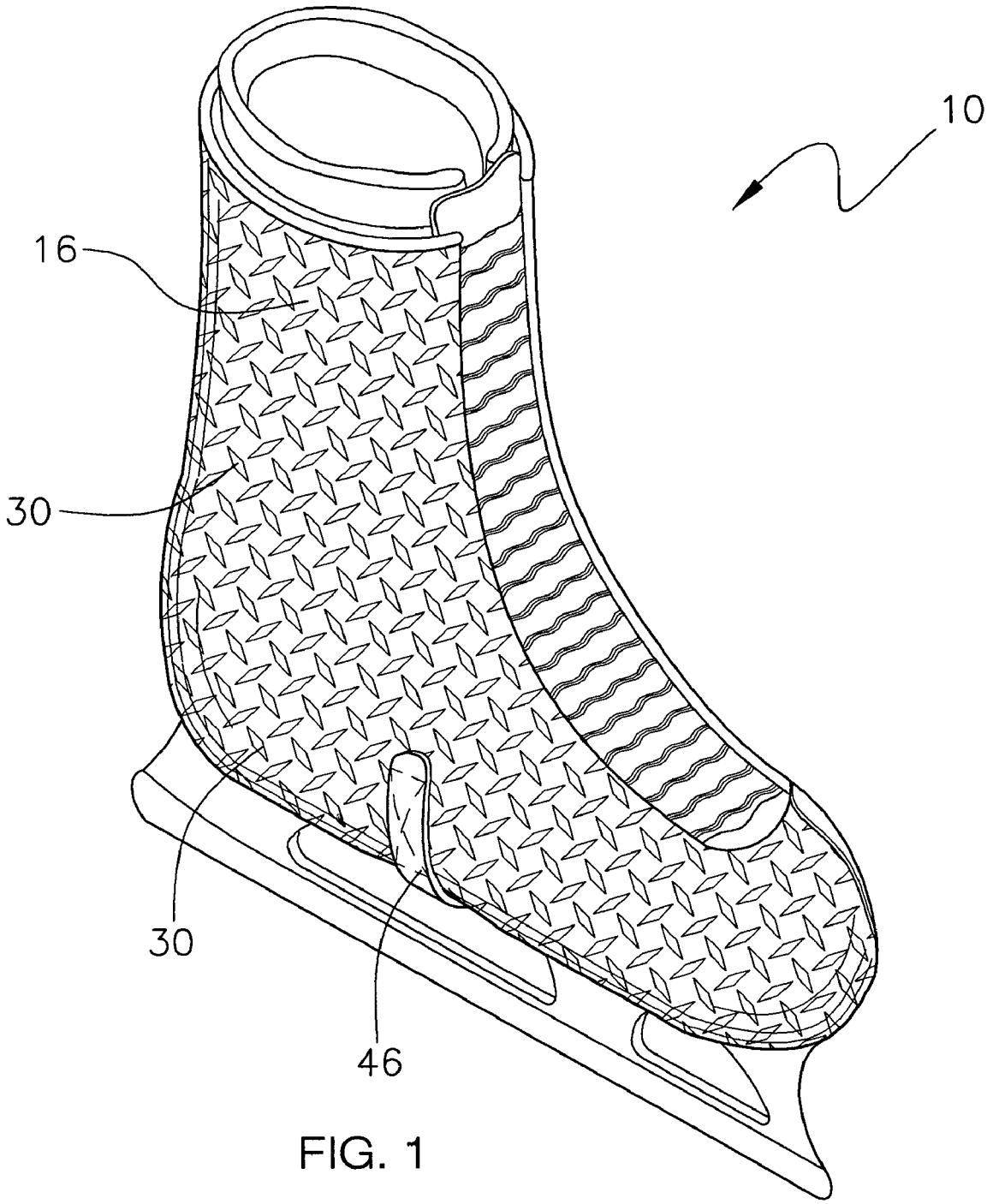
FIG. 1 is a schematic perspective view of a puck deflecting hockey skate covering according to the present invention.
Figure 2:
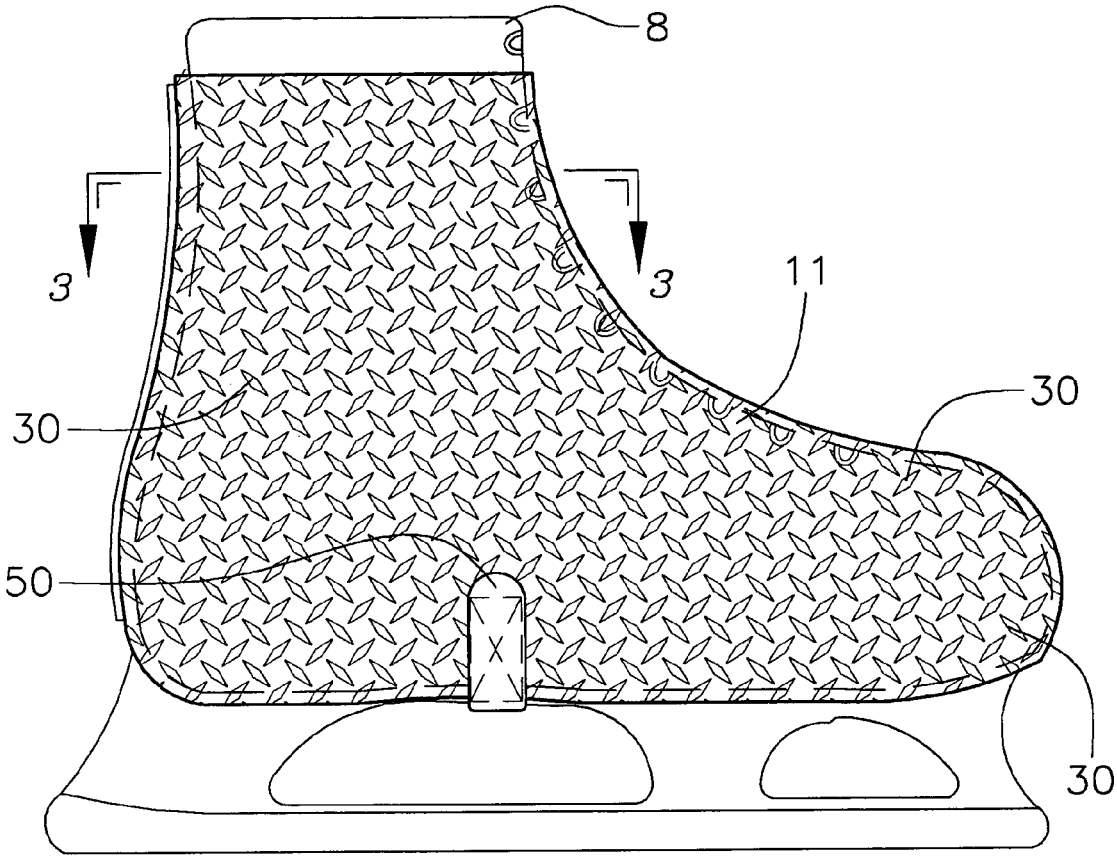
FIG. 2 is a schematic side view of the present invention.
Figure 3:
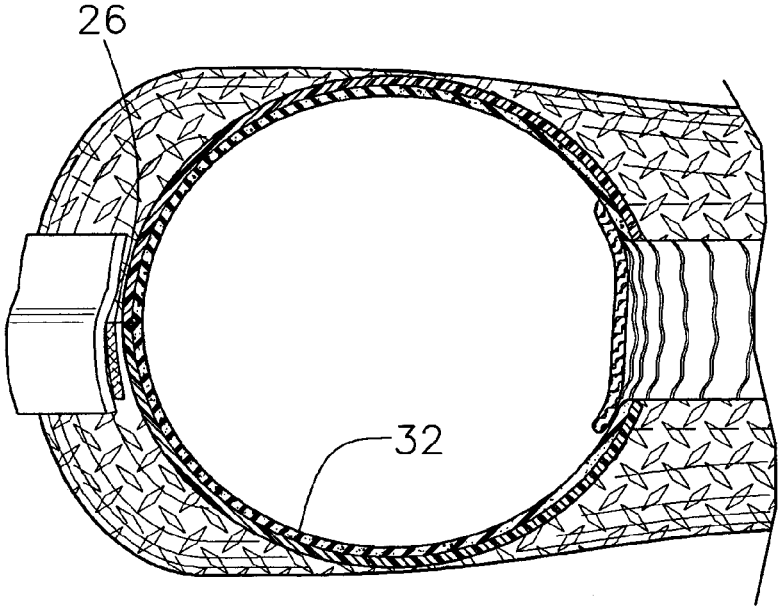
FIG. 3 is a schematic cross-sectional view taken along line 3—3 of FIG. 2 of the present invention.
Figure 4:
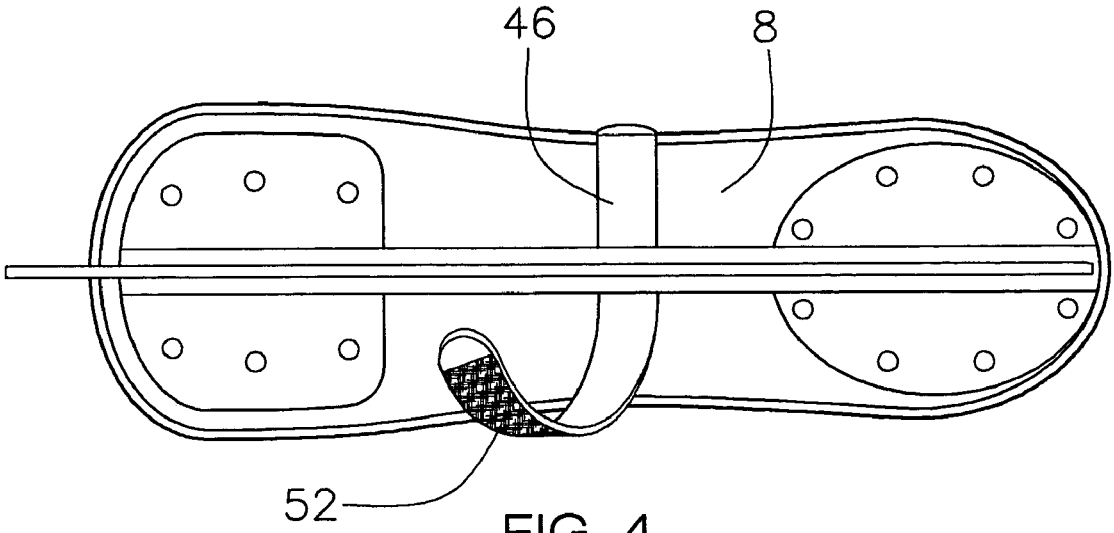
FIG. 4 is a schematic bottom view of the present invention.
Figure 5:
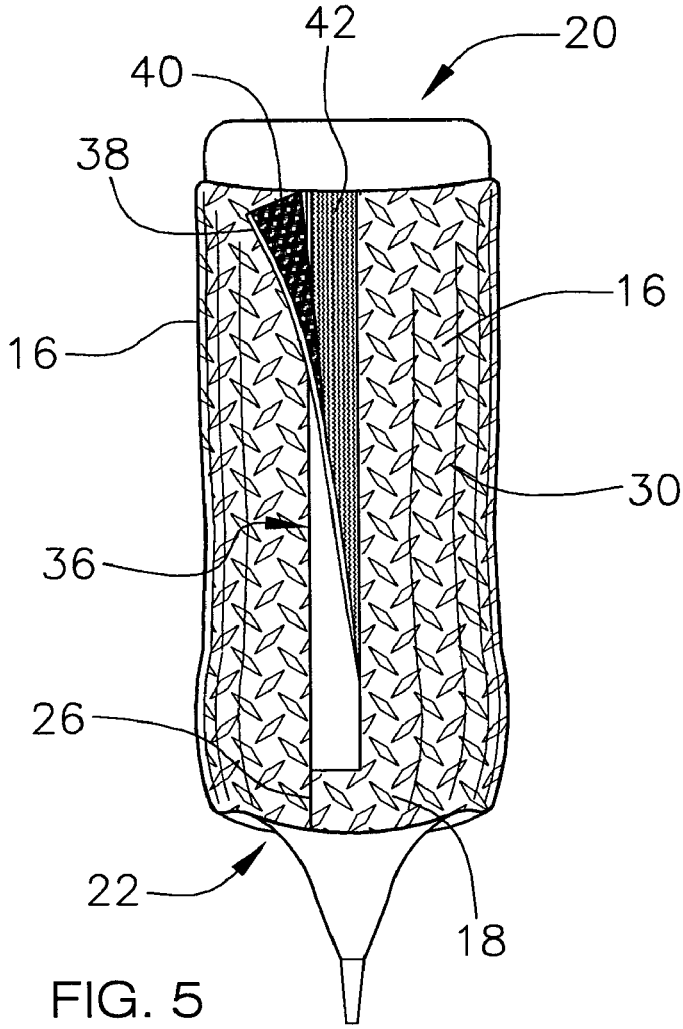
FIG. 5 is a schematic rear view of the present invention.
Figure 6:
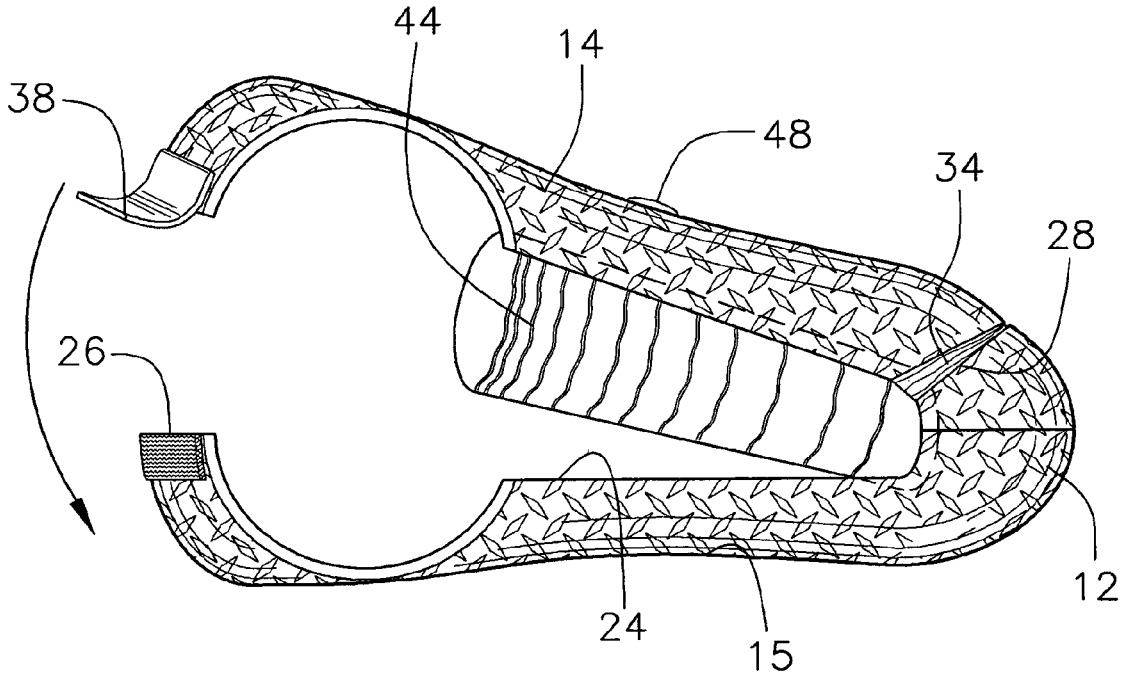
FIG. 6 is a schematic top view of the present invention.

With reference now to the drawings, and in particular to FIGS. 1 through 6 thereof, a new skate covering device embodying the principles and concepts of the present invention and generally designated by the reference numeral 10 will be described.

As best illustrated in FIGS. 1 through 6, the puck deflecting hockey skate covering device 10 generally comprises a covering 11 generally having the shape of a hockey skate 8 and includes a toe portion 12, a pair of side walls 14, 15 a pair of ankle portions 16 and a back wall 18. The covering 11 has an open top side 20 and an open bottom side 22. A tongue slot 24 extends into a peripheral edge of the top side 20 and toward the toe portion 12. The back wall 18 has a break therein from the top side 20 to the bottom side 22 and defines a rear break 26. The toe portion 12 has a break therein defining a front break 28 and extends from the bottom side 22 to the tongue slot 24. The front break 28 is preferably positioned nearer and one of the side walls 14, 15 than the other. The covering 11 comprises a substantially rigid material. The material may comprise a hard plastic or a metal encased in a plastic, but preferably comprises a carbon composite material. An outer surface of the covering 11 has a plurality of protrusions 30 extending outwardly away therefrom. The protrusions 30 have a substantially uniform shape and preferably are evenly distributed on the outer surface such that they are spaced up to one inch from each other. The protrusions 30 ideally have a substantially pyramidal shape, though this shape may include either three sides or four sides. The protrusions 30 generally extend between 1/16 inch and 1/4 inch upwardly from the outer surface. Preferably, a cushioning material 32 is attached to and substantially covers an inner surface of the covering.

A flexible hinge member 34 is attached to and extends along the front break 28. The hinge 34 may be comprised of a resiliently elastic elastomer or a plastic material.

A securing member 36 is attached to the rear break 26 for selectively opening or closing the rear break 26. The securing member 36 preferably includes a flap 38 being attached to extending along one of the edges of the rear break 26. A hook and loop securing combination includes a first portion 40 attached to the flap 38 and a second portion 42 attached to the back wall 18 adjacent to the other of the edges of the rear break 26 for selectively securing the flap 38 in a closed position abutting the back wall 18.

Preferably, a tongue 44 is attached to an inner surface of the toe portion 12 and extends upwardly to the top side 20. The tongue 44 may also be attached along one of the edges of the tongue slot 24 to ensure that it remains stable. The tongue 44 preferably comprises a resiliently flexible material such as KEVLAR available from DuPont. Information on this material may be found at www.dupont.com/kevlar.

A strap 46 has a first end 48 and a second end 50. The first end 46 is attached to a first 14 of the side walls and a fastener 52 removably fastens the second end 50 of the strap 46 to a second 15 of the side walls such that the strap 46 may selectively traverse the bottom side 22. The fastener 52 preferably includes a hook and loop securing combination.

In use, the device 10 is positioned over a conventional hockey skate 8 and is to be worn by others besides the goalie. The strap 46 is extended under the hockey skate 8 to secure it to the hockey skate. The front 28 and rear 26 breaks allow for some variation in the size of the hockey skate 8. The player uses the covering device 10 to protect their foot while the protrusions 30 provide the players with better puck deflecting control.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hockey skate sheath for deflecting and absorbing an impact from a hockey puck, said hockey skate sheath comprising:

a covering generally having the shape of a hockey skate and including a toe portion, a pair of side walls, a pair of ankle portions and a back wall, said covering having an open top side and an open bottom side, said covering comprising a substantially rigid material, an outer surface of said covering having a plurality of protrusions thereon;

a tongue slot extending into a peripheral edge of said top side and extending toward said toe portion, a tongue being attached to an inner surface of said toe portion and extending upwardly to said top side, said tongue comprising a resiliently flexible material; and a strap having a first end and a second end, said first end being attached to a first of said side walls, a fastener removably fastening said second end of said strap to a second of said side walls such that said strap may selectively traverse said bottom side.

2. The hockey skate sheath of claim 1, wherein said back wall has a break therein from said top side to said bottom side and defining a rear break, a securing member being attached to said rear break for selectively opening or closing said rear break.

3. The hockey skate sheath of claim 2, wherein said toe portion has a break therein defining a front break and extending from said bottom side to said tongue slot, a flexible hinge member being attached to and extending along said front break.

4. The hockey skate sheath of claim 1, wherein each of said protrusions has a substantially uniform shape, said protrusions being evenly distributed on said outer surface.

5. The hockey skate sheath of claim 4, wherein each of said protrusions have a substantially pyramidal shape.

6. A hockey skate sheath for deflecting and absorbing an impact from a hockey puck, said hockey skate sheath comprising:

a covering generally having the shape of a hockey skate and including a toe portion, a pair of side walls, a pair of ankle portions and a back wall, said covering having an open top side and an open bottom side, a tongue slot extending into a peripheral edge of said top side and extending toward said toe portion, said back wall having a break therein from said top side to said bottom side and defining a rear break, said toe portion having a break therein defining a front break and extending from said bottom side to said tongue slot, said covering comprising a substantially rigid material, an outer surface of said covering having a plurality of protrusions, said protrusions having a substantially uniform shape and being evenly distributed on said outer surface;

a flexible hinge member being attached to and extending along said front break;

a securing member being attached to said rear break for selectively opening or closing said rear break;

a tongue being attached to an inner surface of said toe portion and extending upwardly to said top side, said tongue comprising a resiliently flexible material;

a strap having a first end and a second end, said first end being attached to a first of said side walls, a fastener removably fastening said second end of said strap to a second of said side walls such that said strap may selectively traverse said bottom side; and a cushioning material being attached to and substantially covering an inner surface of said covering.

* * * * *